US005803206A

United States Patent [19]

Halstead et al.

[11] Patent Number: 5,803,206

[45] Date of Patent: Sep. 8, 1998

[54] HOIST LOCKING AND RELEASE APPARATUS

[75] Inventors: Jon S. Halstead, La Jolla; Anthony J. Halstead, National City, both of Calif.

[73] Assignee: Western Hoist, Inc., National City, Calif.

[21] Appl. No.: 645,690

[22] Filed: May 14, 1996

[51] Int. Cl.[6] ..... B66B 9/00

[52] U.S. Cl. ..... 187/208; 187/359

[58] Field of Search ..... 187/207, 208, 187/352, 359

[56] References Cited

U.S. PATENT DOCUMENTS

| | | | |
|---|---|---|---|
| 274,770 | 3/1883 | Herrick | 187/359 |
| 2,266,915 | 12/1941 | Steedman | 187/208 X |
| 2,956,643 | 10/1960 | Halstead | 187/8.49 |
| 3,098,542 | 7/1963 | Wallace et al. | 187/8.49 |
| 3,237,722 | 3/1966 | Citroën | 187/8.59 |
| 4,457,401 | 7/1984 | Taylor et al. | 187/8.49 |
| 4,976,336 | 12/1990 | Curran | 187/8.5 |

FOREIGN PATENT DOCUMENTS

| | | | |
|---|---|---|---|
| 566195 | 10/1993 | European Pat. Off. | 182/208 |
| 583073 | 12/1977 | U.S.S.R. | 187/359 |

*Primary Examiner*—Boris Milef

*Attorney, Agent, or Firm*—Brown, Martin, Haller & McClain, LLP

[57] ABSTRACT

A hoist lifting apparatus for vehicles has a pair of spaced posts and a carriage slidably mounted for vertical movement in each post and secured to load bearing arms for supporting a vehicle. A locking assembly is pivotally mounted on each carriage for locking it in a selected, raised position. The post has a wall facing the carriage with a series of vertically spaced openings, and a locking arm pivotally mounted on the carriage is biased into successive openings as the carriage is raised. Once the desired height is reached, the carriage is lowered slightly in order to lock the arm in a selected opening. A release cam is pivotally mounted on the locking arm and acts to release the locking arm from the selected opening when the carriage is raised slightly from a locked position. A bypass member holds the locking arm in the retracted position as the carriage is lowered after release of the lock.

13 Claims, 4 Drawing Sheets

HOIST LOCKING AND RELEASE APPARATUS

BACKGROUND OF THE INVENTION

The present invention relates generally to hydraulic lifting devices or hoists for raising loads such a vehicles above the ground so that mechanics may work underneath the vehicle, and is particularly concerned with a locking and release apparatus for locking of the hoist in a raised position, and subsequently releasing the locking device to allow the hoist to be lowered.

Typical hydraulic lifts or hoists for vehicles have two columns between which the vehicle is supported. A carriage is slidably mounted in each post or column, and is driven up and down by a hydraulic lifting mechanism. Suitable load bearing arms are secured to each carriage. A locking mechanism is associated with each carriage for securing the vehicle at the desired position. One problem with such conventional lifting devices is that the lock must normally be released manually, and the lock on each post must be manually released before a vehicle can be lowered back to the ground. In some cases, a cable release is provides so that the locks on each side can be released simultaneously by a cable pull. In other cases, air valve release mechanisms have been used. However, both of these alternatives are subject to some technical problems.

U.S. Pat. No. 2,956,643 of Halstead describes an automatic safety lock for automobile lifts having submerged hydraulic cylinders. As the piston is raised, a latching bar rotates automatically under the action of gravity into a latched position. If the lift fails, the bar will prevent the piston from retracting into the cylinder and will therefore stop the falling of the lift. The bar must be manually released for the lift to be lowered.

In U.S. Pat. No. 4,976,336 of Curran, a lifting apparatus has two posts on each side, each having a slidably mounted carriage which is driven up and down by an hydraulic actuator. A mechanical locking mechanism is provided in association with each carriage. A safety catch is pivotally mounted on the carriage and is linked to an actuating lever. The safety catches are connected by a cable so that they are operated together. The catches extend into openings in the posts to lock the carriage in position, and are released by pressing the actuating lever handle.

SUMMARY OF THE INVENTION

It is an object of this invention to provide a new and improved locking device for a vehicle lift or hoist.

According to the present invention, a lifting apparatus for lifting loads is provided, which comprises a pair of vertical posts for mounting on the ground, a carriage slidably mounted on each post, a drive unit for driving each carriage up and down on the respective post, a series of lock openings on each post, and a ratchet or locking arm pivotally mounted on each carriage for engagement in one of the lock openings to secure the carriage at a selected height. The locking arm is biased by a spring or the like into an extended position engaging in a selected lock opening. A release cam is pivotally mounted on the locking arm and acts to release the locking arm automatically if the carriage is raised from a locked position, by biasing the arm back out of the lock opening. A bypass mechanism is used to hold the arm in the retracted position as the carriage is lowered back down to the ground.

With this arrangement, the need for manual release of locks on one or both posts is avoided. All that is necessary in order to release the lock is to actuate the drive unit to raise the carriage a short distance, and then lower the carriage back to the ground. As the carriage is initially being raised, prior to locking in position, the locking arm will be free to pivot back and forth out of the lock openings. Once the carriages are at the desired height, the carriage is simply lowered slightly. This acts to urge the release cam into an armed position in an aligned opening in the post, and also locks the locking arm into another of the openings. At this point, the only way that the lock can be released is to raise the carriage. This rotates the release cam out of its aligned opening and the movement of the release cam simultaneously urges the locking arm out of its opening to release the carriage to be lowered.

This arrangement provides an easy and convenient way to operate a vehicle hydraulic lift, or a lifting apparatus for lifting other types of loads. Unreliable cable linkages and the like can be avoided, and the device can be operated reliably and efficiently by simple operation of the existing drive unit to drive the carriage in the appropriate direction to engage the lock and subsequently to release the lock when work on the vehicle is completed.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
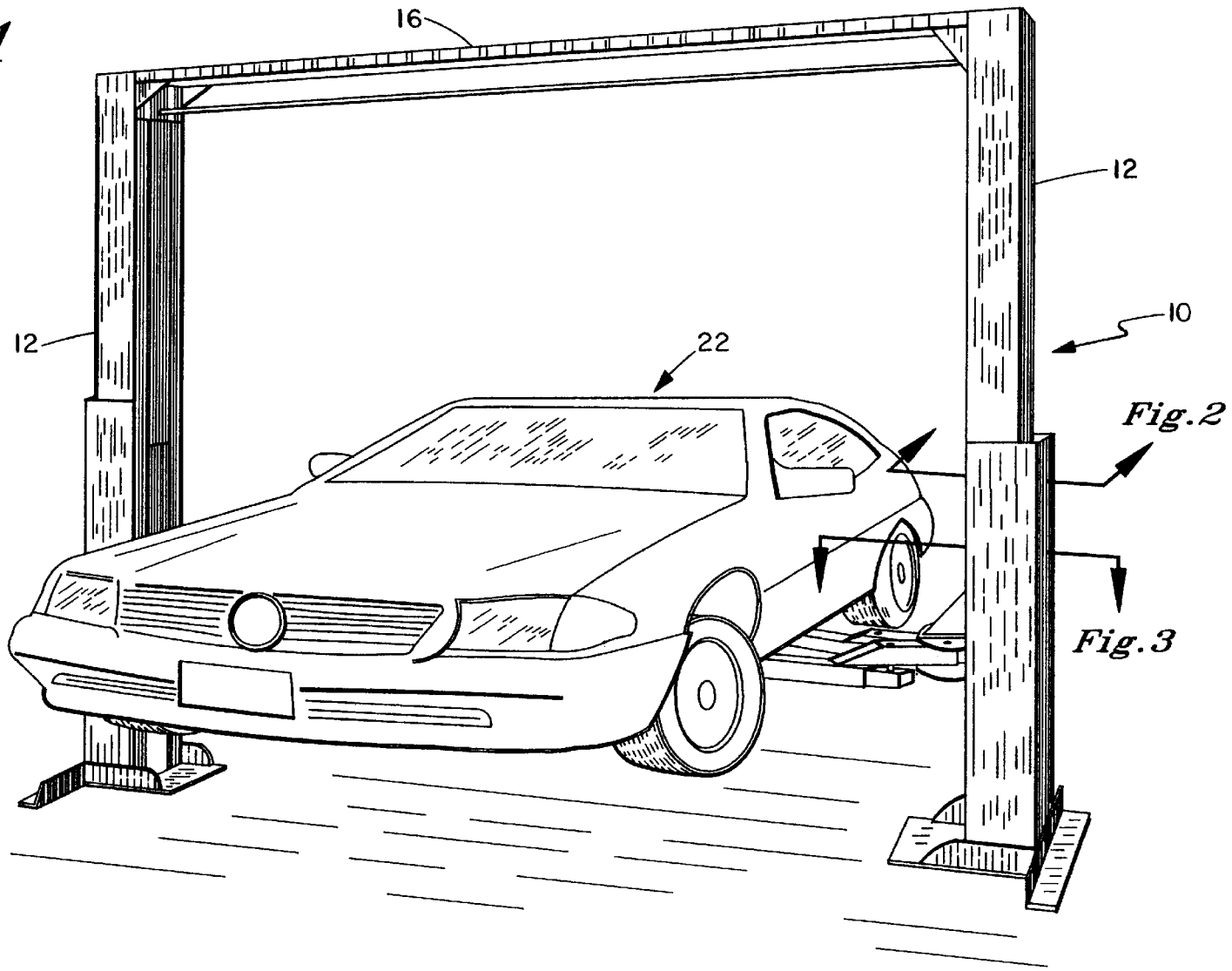
FIG. 1 is a perspective view of an above-ground vehicle lifting apparatus incorporating a locking assembly according to a preferred embodiment of the present invention.
Figures 2, 3:
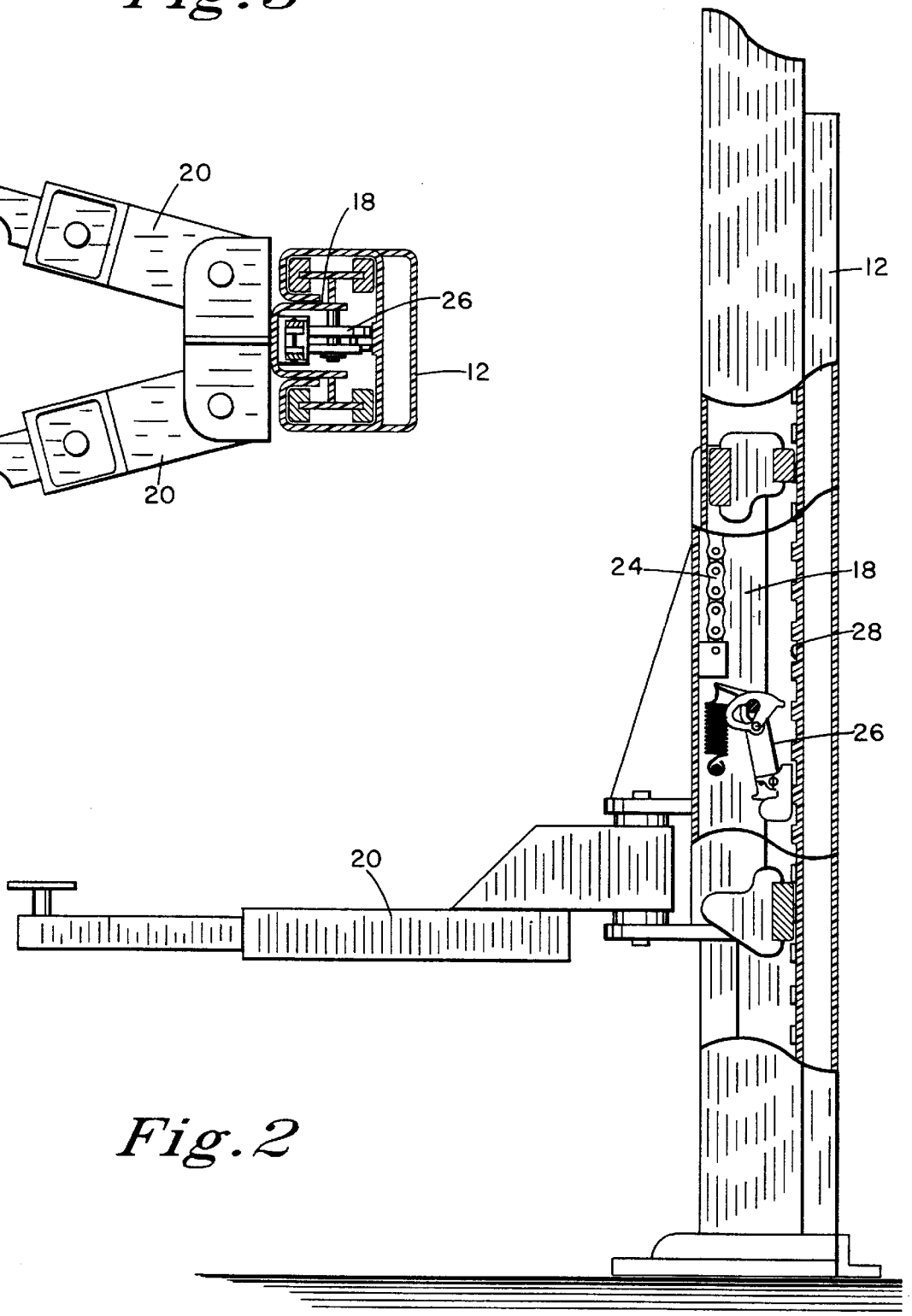
FIG. 2 is a front elevational view of one of the columns or posts of the lifting apparatus of FIG. 1, partially broken away to reveal the locking assembly.
FIG. 3 is a section on the lines 3—3 of FIG. 1.

FIG. 1 of the drawings illustrates an above-ground vehicle lift or hoist device 10 comprising a pair of spaced, vertical posts or columns 12 suitably supported or secured to the ground at their base and secured together at their upper ends by a suitable connecting arm or gantry 16. As illustrated in FIG. 2, a carriage 18 is slidably mounted in each post 12 and supports suitable load bearing arms 20 which project from the posts to engage beneath a vehicle 22 located between the posts, as generally illustrated in FIG. 1. The carriages are driven up and down the posts by a suitable drive mechanism (not illustrated), such as a hydraulic cylinder and piston, as is well known in the field.

As best illustrated in FIGS. 2 and 3, carriage 18 is secured to the lifting or drive mechanism by lifting chain 24. A locking assembly 26 is pivotally mounted on each carriage, and is designed for engagement in spaced openings or recesses 28 in one wall of the post, as best illustrated in FIGS. 2 and 4–9.

The locking assembly includes a ratcheting trigger plate 30 which is pivotally mounted on carriage 18 by means of a main axle pin 32 which extends through a slot 34 in plate 30. Plate 30 has an ear 36 at one end which is linked to a biasing spring 38 for biasing the opposite end 40 of the plate into an aligned recess 28. Spring 38 is secured to the carriage at its opposite end. A ratchet bypass cam 42 pivots on pin 44 to the locking end of plate 30. Cam 42 is gravity biased into the lowermost position illustrated in FIG. 4. In this position, a projecting portion 46 of the cam 42 engages a stop pin 48 on trigger plate 30 and a flat side 50 of cam 42 is located vertically against the wall of the post. Cam 42 is rotatable in a clockwise direction from the vertical position illustrated in FIG. 4 to the horizontal orientation illustrated in FIG. 5, in which a recess 52 on the edge of the cam contacts stop pin 48 to prevent motion beyond this point. At the same time, an end face 54 of the cam is substantially aligned with locking end 40 of the trigger plate 30 in the horizontal position. The enlarged, rounded end 55 of the cam provides a biasing weight to urge the cam into the vertical orientation, as will be explained in more detail below.

A release cam or trigger 56 is pivotally secured to the ratcheting plate by pivot pin 58 at a location spaced above cam 42. Cam 56 has a shaped cam opening 60 through which the end of axle pin 32 projects. The cam opening 60 is generally heart-shaped, with rounded seat portions 61,62,63 for the pin 32 in different cam positions. The outer edge of cam 56 is approximately V- or triangular shape, with a rounded upper edge 64 and a projecting ear 65 at one end of edge 64 facing the recessed wall of the post.

Operation of the locking and release assembly will now be described in more detail with reference to FIGS. 4–9. A vehicle will be mounted on the supporting arms of the hoist by driving into position between the posts with the two carriages in the lowermost position. The lifting arms will then be attached to the undercarriage of the vehicle. The locking assembly will be in the position illustrated in FIG. 4. In this position, axle pin 32 is at the upper end of slot 34 and spring 38 biases the locking end or edge 40 of plate 30 towards the opposing wall of the post. The ratchet bypass cam 42 is gravity biased into the vertical orientation in which flat edge 50 is vertical and biased against the opposing wall of the post, and portion 46 engages stop pin 48. At the same time, the release cam 56 is in an inoperative condition, in which axle pin 32 is seated in seat portion 63 and the cam 56 is spaced away from the opposing wall and recesses 28.

As the carriage is raised, the end face 54 of ratchet bypass cam 42 engages the first of a series of projecting steps or teeth 66 between which the openings 28 are located. This acts to rotate the cam 42 in a clockwise direction between the vertical orientation of FIG. 4 and the horizontal orientation of FIG. 5, in which the recess 52 engages stop pin 48. The cams 42 and 56 remain in this position as the carriage continues to be raised. In this position, the mechanism is in an armed, locking position. As long as the carriage continues to move upwardly, the cam 42 and ratchet plate 30 will ratchet freely in and out of the successive openings or recesses 28 by pivoting about pivot pin 32.

Figure 6:
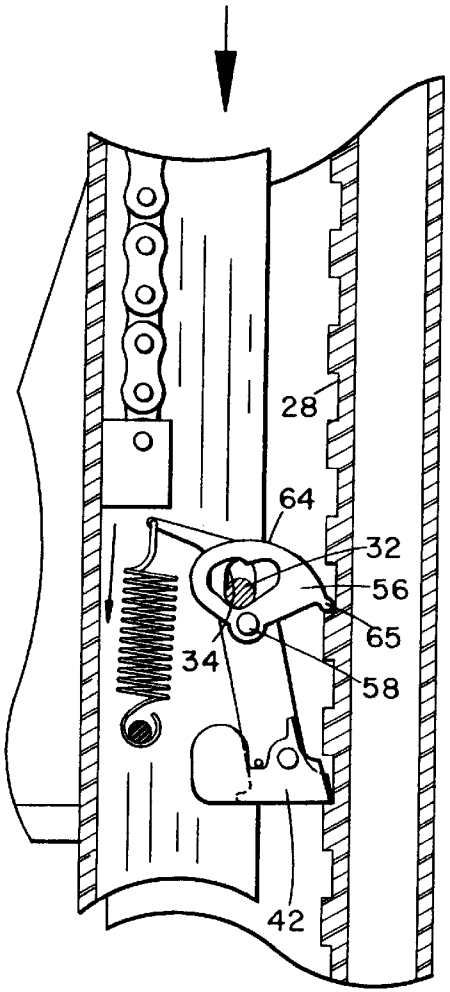
FIG. 6 is a view similar to FIGS. 4 and 5, illustrating lowering of the carriage to engage the locking assembly in a locked position.
Figure 5:
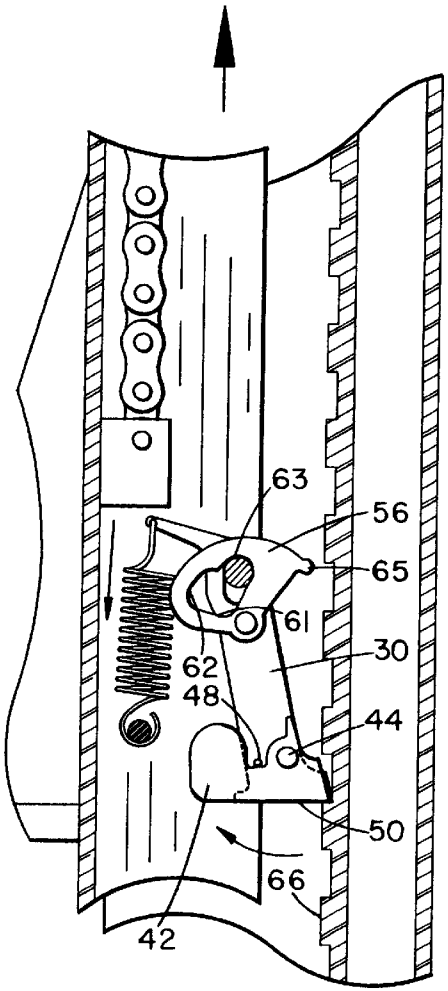
FIG. 5 is a view similar to FIG. 4, illustrating a subsequent position of the locking assembly as the carriage is raised.
Figure 4:
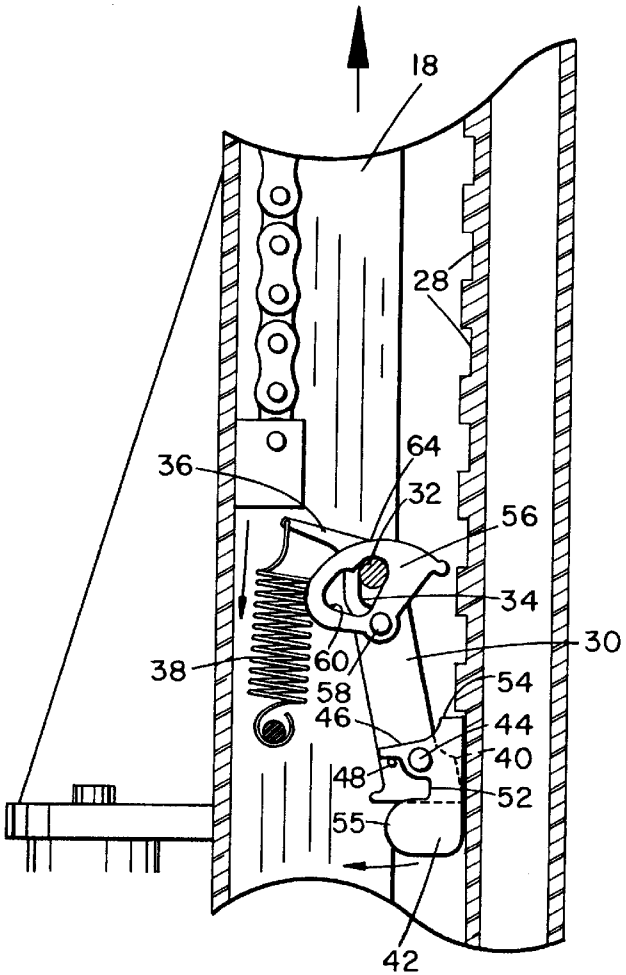
FIG. 4 is an enlarged side elevational view of the locking assembly in an initial, unlocked position as raising of the carriage is commenced.

Once the desired elevation is reached, the lock is engaged by lowering the carriage slightly, into the position illustrated in FIG. 6. Pin 32 travels to the lower end of slot 34, at the same time traveling around the perimeter of cam opening 60 in release cam 56, causing the cam plate 56 to pivot about pivot pin 58 until ear 65 engages in an opening or recess 28 in the rear wall of the vertical column or post. The release cam is now in an armed or cocked position. At the same time, the lower end faces of the plate 30 and bypass cam 42 engage the lower end of the opening 28 in which they are engaged, preventing any further downward movement of the carriage and locking the carriage in position.

Figure 9:
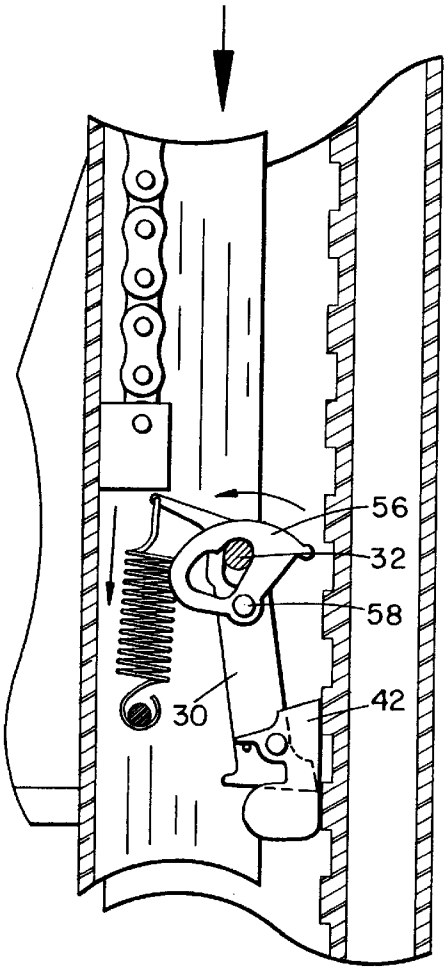
FIG. 9 is a view similar to FIG. 8, illustrating a subsequent stage in lowering of the carriage after lock release.
Figure 8:
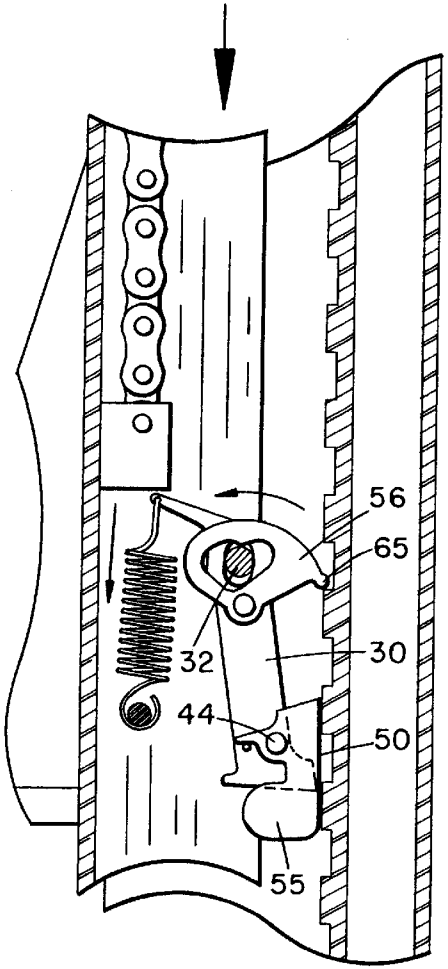
FIG. 8 is a view similar to FIG. 7, illustrating a first stage in lowering of the carriage after release of the lock.
Figure 7:
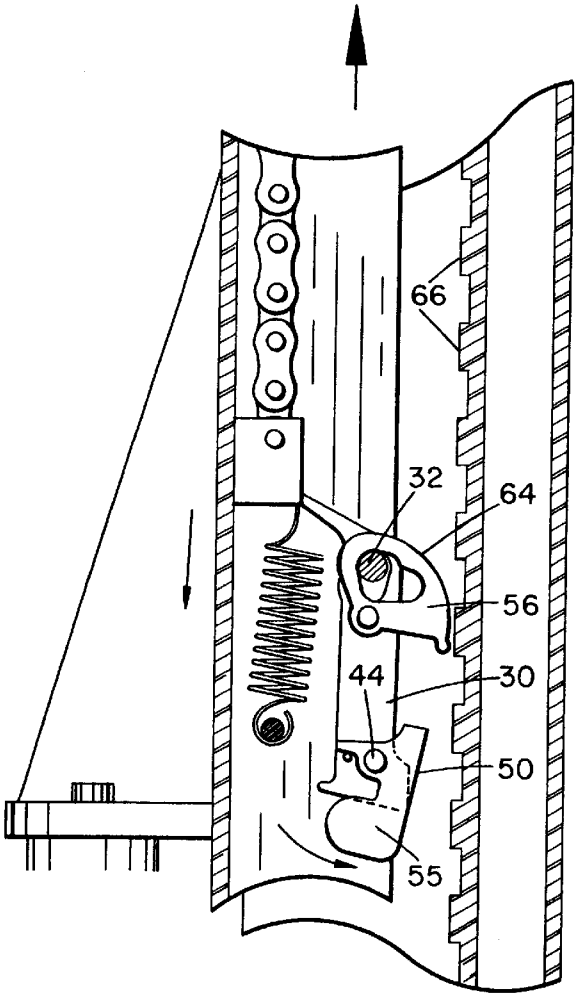
FIG. 7 is a view similar to FIGS. 4–6, illustrating subsequent raising of the carriage to release the lock.

All that is necessary in order to release the locking mechanism and lower the carriage is that the carriage is first raised slightly, as indicated in FIG. 7. The outer curved edge 64 of release cam 56 engages the upper end of the opening in which the ear 65 was engaged, forcing the cam to rotate in a clockwise direction out of the opening so that the curved face bears against the outer face of step 66. At the same time, pin 32 travels back up in slot 34, engaging in seat portion 62 of cam opening 60. These actions simultaneously cause the ratchet plate 30 and attached cam 42 to pivot in a clockwise direction out of the opening in which they were previously engaged. As soon as cam 42 is clear of opening 28, it is free to rotate downwardly about pivot 44 due to the weight of the enlarged end 55, as indicated by the arrow in FIG. 7, until it reaches the vertical orientation of FIG. 8. The flat end face 50 then engages the wall of the column as the carriage is lowered, preventing the projecting end 40 of the ratchet plate from entering any of the openings and interfering with smooth descent of the carriage. As the carriage descends, the ear 65 of release cam 56 will engage the lower edge of the closest opening, urging the cam 56 to rotate back in an anti-clockwise direction as indicated in FIG. 8, while the cam opening travels around the pin 32 until it is again positioned in the armed position, as illustrated in FIG. 9. The locking mechanism is now reset and ready for the next lifting operation.

The advantage of this locking and release mechanism is that the lock can be released automatically by the operator simply by raising the carriage slightly before lowering the carriage, as compared to prior art devices which had to be released manually. The locking and release mechanism is reliable and easy to operate, and does not require separate release on each side of the hoist. As the device is lowered slightly to engage the lock, the release cam or trigger is simultaneously armed, so that subsequent raising of the carriage will automatically release the lock.

Although a preferred embodiment of the present invention has been described above by way of example only, it will be understood by those skilled in the field that modifications may be made to the disclosed embodiment without departing from the scope of the invention, which is defined by the appended claims.

We claim:

1. A lifting apparatus for lifting loads, comprising:

first and second spaced vertical posts;

a first carriage slidably mounted on the first post;

a second carriage slidably mounted on the second post;

a drive mechanism for driving the first and second carriages up and down the respective posts;

each post having a wall facing the respective carriage, the wall having a series of vertically spaced recesses;

a first locking assembly pivotally mounted on the first carriage;

a second locking assembly pivotally mounted on the second carriage;

each locking assembly including a ratchet plate pivotally secured to the respective carriage and having a projecting locking portion, a biasing member for biasing the plate towards a locking position in which the locking portion engages in an aligned recess in the post wall, the ratchet plate being pivotable back and forth into and out of successive wall recesses as the respective carriage is raised, and being locked in a selected recess when the respective carriage is lowered;

each locking assembly further including a lock release cam for releasing the ratchet plate from an aligned recess to allow the respective carriage to be lowered, and a by-pass member for holding the ratchet plate in a retracted position in which the locking portion is clear of the wall recess as the respective carriage is lowered; and each lock release cam including a portion for engaging the post wall to bias the ratchet plate out of an aligned recess when the respective carriage is raised from a locked condition.

2. The apparatus as claimed in claim 1, wherein the ratchet plate comprises an elongated plate having a first projecting portion at one end projecting away from the post wall, a second projecting portion at the opposite end projecting towards the post wall comprising said locking portion, and an elongate slot at a location intermediate said ends, the respective carriage having a pivot pin projecting through said slot, and the biasing member comprising a spring having a first end secured to said respective carriage and a second end secured to said first projecting portion.

3. The apparatus as claimed in claim 1, wherein said ratchet plate has an upper end secured to said biasing member, and a lower end including said locking portion, and is pivotally mounted on the respective carriage at a location intermediate said ends.

4. The apparatus as claimed in claim 3, wherein said ratchet plate has an elongate slot and said respective carriage has a pivot pin extending through said slot comprising the pivotal connection between said ratchet plate and respective carriage, the pivot pin being movable relative to said ratchet plate between opposite ends of said slot.

5. The apparatus as claimed in claim 3, wherein said bypass member comprises a bypass cam pivotally mounted adjacent the lower end of said ratchet plate, the bypass cam being rotatable between a vertical position and a horizontal position, and having a flat edge for riding over said post wall in said vertical position to prevent said locking portion from entering any of said respective recesses.

6. The apparatus as claimed in claim 5, wherein the bypass cam has an enlarged end portion on one side of said pivotal mounting for biasing said bypass cam into said vertical orientation and an opposite end portion on the opposite side of said pivotal mounting for engaging a step in said post wall to bias said bypass cam into said horizontal orientation as said respective carriage is raised, whereby said ratchet plate can pivot into aligned recess in said post wall.

7. The apparatus as claimed in claim 3, wherein said lock release cam is pivotally secured to said ratchet plate at a location spaced above said bypass member, the lock release cam being rotatable between an inactive position and an armed position, and including a projecting portion extending into a second aligned recess in said post wall in said armed position, the projecting portion comprising means for engaging said post wall above said second aligned recess as the carriage is raised from said locked position to bias said ratchet plate out of the first aligned recess and release the respective carriage from the locked position.

8. The apparatus as claimed in claim 3, wherein said lock release cam and bypass member comprise at least two cam plates pivotally secured to said ratchet plate at spaced positions.

9. A lifting apparatus for lifting loads, comprising:

first and second spaced vertical posts;

a first carriage slidably mounted on the first post;

a second carriage slidably mounted on the second post;

a drive mechanism for driving the first and second carriages up and down the respective posts;

each post having a wall facing the respective carriage, the wall having a series of vertically spaced recesses;

a first locking assembly pivotally mounted on the first carriage;

a second locking assembly pivotally mounted on the second carriage;

each locking assembly including a ratchet plate pivotally secured to the respective carriage and having a projecting locking portion, a biasing member for biasing the plate towards a locking position in which the locking portion engages in an aligned recess in the post wall, the ratchet plate being pivotable back and forth into and out of successive wall recesses as the respective carriage is raised, and being automatically locked in a selected recess when the respective carriage is lowered while the locking portion is engaged in said selected recess to retain the respective carriage in a locked position; and each locking assembly further including a lock release device movable between an armed position and an inactive position, the lock release device being automatically movable into said armed position when said respective carriage is lowered into said locked position, and being automatically movable from said armed position into said inactive position when said respective carriage is raised from said locked position, said lock release device comprising means for automatically releasing the locking portion of the ratchet plate from the selected recess when the respective carriage is raised slightly from said locked position, whereby the respective carriage can be freely lowered after release of said ratchet plate.

10. The apparatus as claimed in claim 9, wherein the locking assembly further includes a bypass member for holding said ratchet plate in a retracted position in which said locking portion is clear of said post wall recess as the respective carriage is lowered after release of the locked portion.

11. The apparatus as claimed in claim 10, wherein the bypass member comprises a bypass cam plate rotatably mounted on said ratchet plate, the bypass cam plate being rotatable between a first, inoperative position in which said ratchet plate is pivotable back and forth into said recesses as said respective carriage is raised, and a second, operative position for holding said ratchet plate clear of said recesses after said ratchet plate has been released from a locked position by raising said respective carriage from said locked position.

12. A lifting apparatus for lifting loads, comprising:

a first carriage slidably mounted on the first post;

a second carriage slidably mounted on the second post;

a drive mechanism for driving the first and second carriages up and down the respective posts;

each post having a wall facing the respective carriage, the wall having a series of vertically spaced recesses;

a first locking assembly pivotally mounted on the first carriage;

a second locking assembly pivotally mounted on the second carriage;

each locking assembly including a ratchet plate pivotally secured to the respective carriage and having a projecting locking portion, a biasing member for biasing the plate towards a locking position in which the locking portion engages in an aligned recess in the post wall, the ratchet plate being pivotable back and forth into and out of successive wall recesses as the respective carriage is raised, and being automatically locked in a selected recess when the respective carriage is lowered while the locking portion is engaged in said selected recess to retain the respective carriage in a locked position;

each locking assembly further including a lock release device for automatically releasing the locking portion of the ratchet plate from the selected recess when the respective carriage is raised slightly from said locked position, whereby the respective carriage can be freely lowered after release of said ratchet plate; and said lock release device comprising a release cam pivotally mounted on said ratchet plate, said release cam being rotatable between an inactive position and an armed position, a trigger portion of said release cam extending into a second aligned recess of said post wall above said selected recess when the respective carriage is lowered into a locked position, said trigger portion engaging an upper end of said second recess as the respective carriage is raised from said locked position to release said lock, and comprising means for biasing said ratchet plate locking portion out of said selected recess to release the respective carriage.

13. A lifting apparatus for lifting loads, comprising:

first and second spaced vertical posts;

a first carriage slidably mounted on the first post;

a second carriage slidably mounted on the second post;

a drive mechanism for driving the first and second carriages up and down the respective posts;

each post having a wall facing the respective carriage, the wall having a series of vertically spaced recesses;

a first locking assembly pivotally mounted on the first carriage;

a second locking assembly pivotally mounted on the second carriage;

each locking assembly including a locking member pivotally secured to the respective carriage, a biasing member for biasing the locking member towards a locking position in which the locking portion engages an aligned recess in said post wall, the locking member being pivotable back and forth into and out of a series of successive recesses as the respective carriage is raised, and being automatically locked in a selected recess when the respective carriage is lowered at a selected position to retain the locking member and respective carriage in a locked position; and each locking assembly further including a lock release device automatically movable back and forth between an armed position and an inoperative position, said lock release device comprising a cam mechanism for automatically releasing said locking member from said recess when said lock release device moves from said armed position to said inoperative position, said lock release device having portions for engaging said post wall as the respective carriage is raised from said locked position to move said lock release device into said inoperative position, and for engaging said post wall as the respective carriage is lowered after release of said locking member to move said lock release device automatically back into said armed position.

* * * * *